United States Patent [19]

Bowen

[11] Patent Number: 4,476,900

[45] Date of Patent: Oct. 16, 1984

[54] COMPOSITE HEDDLE ROD

[75] Inventor: James B. Bowen, Greenville, S.C.

[73] Assignee: Steel Heddle Manufacturing Company, Greenville, S.C.

[21] Appl. No.: 343,051

[22] Filed: Jan. 27, 1982

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 2,674,273 | 4/1954 | Blickenstorfer | 139/92 |
| 2,674,274 | 4/1954 | Blickenstorfer | 139/92 |
| 3,754,577 | 8/1973 | Heller | 139/92 |
| 4,106,529 | 8/1978 | Kaufmann | 139/92 |
| 4,106,530 | 8/1978 | Kaufmann | 139/92 |

FOREIGN PATENT DOCUMENTS

| | | | |
|---|---|---|---|
| 2610311 | 9/1977 | Fed. Rep. of Germany | 139/91 |
| 2933442 | 1/1981 | Fed. Rep. of Germany | 139/91 |
| 404581 | 7/1966 | Switzerland | 139/91 |
| 525305 | 8/1972 | Switzerland | 139/91 |
| 1308326 | 2/1973 | United Kingdom | 139/91 |
| 2058855 | 4/1981 | United Kingdom | 139/91 |

*Primary Examiner*—Henry Jaudon

*Attorney, Agent, or Firm*—Dority & Flint

[57] ABSTRACT

A heddle rod 16, 42, 44 is disclosed constructed of metal outer layer A and dissimilar metal and/or non-metal core B whereby most impact and wear of the heddle rod with the eye 20 of an associated heddle 18 is taken by the side edges 52, 54 of metal bars A while core B of different elasticity reduces transmission of noise. The overall structure has a high bending resistance and structural integrity to withstand the rigorous forces encountered during shedding on a loom. Other arrangements are provided offering other advantageous constructions.

8 Claims, 6 Drawing Figures

COMPOSITE HEDDLE ROD

BACKGROUND OF THE INVENTION

The invention relates to a construction for a heddle frame in which heddles holding warp yarns are reciprocated up and down in a shedding operation during weaving on a loom. With the advent of high speed shuttleless looms the problem of reducing wear and noise in the parts of rapidly moving sub-assemblies of the loom, such as the heddle frame, is one to which considerable attention has to be given. In the case of the heddle frame, the metal heddles are typically fastened to a metal heddle rod by means of slots in which the heddle rod is received and between which there is considerable wear and noise due to the space and play therebetween as a tight fit is not possible. Moreover, to achieve high speed performance in the loom, the moving parts must weigh as little as possible and in the case of a heddle rod exhibit as high a bending resistance as possible.

In the prior art, it has been proposed to construct a heddle rod from a lightweight fiber reinforced plastic (U.S. Pat. No. 3,754,577) and to apply a metal or ceramic by plating to those regions of the heddle rod subjected to wear (British Pat. No. 1,308,326). In lieu of plating, it has been suggested to snap or glue a sheet-metal covering over the heddle rod to provide higher bending resistance (German Pat. No. 2,933,442).

In an almost opposite approach to the same problem, the use of a light-weight metal rod has been proposed which carries a synthetic plastic material resistant to impact, wear, and abrasion at the locations of impact which can be replaced and renewed (U.S. Pat. No. 4,106,530).

However, the above attempts to providing parts which operate with reduced wear and noise have not been entirely satisfactory. Many of the proposed heddle rod constructions require special plastic to metal connections or special heddle frames and are not readily usable with conventional heddle frames. The use of metal platings and coverings presents problems in the retention of the metal on the heddle rod under the rigorous forces encountered during cyclid reciprocation. Moreover, the metal platings and coverings utilized heretofore have not satisfactorily afforded the light-weight structures resistance to bending as is encountered during high-speed vertical reciprocation.

Accordingly, an important object of the present invention is to provide a heddle rod of light-weight construction having low wear and noise characteristics.

Another important object of the present invention is to provide a heddle rod particularly suitable for high-speed loom operation.

Another important object of the present invention is to provide a light-weight heddle rod which is readily usable with conventional heddle frames and may be reliably attached in accordance with known techniques.

Yet another important object of the present invention is to provide a light-weight heddle rod having a laminated construction of metal and non-metallic materials of different elasticity.

Still another important object of the present invention is to provide a heddle rod constructed having two outer metal layers and a core of dissimilar metal and/or a non-metallic material bonded therebetween providing a high modulus of elasticity in the vertical direction.

SUMMARY OF THE INVENTION

The above objectives are accomplished according to the present invention by providing a laminated construction of two outer metal layers and an inner core of bonded dissimilar metal and/or non-metallic material whereby the wear surface between the heddle rod and heddles is shared by the metal and non-metal materials and a high resistance to bending is achieved along with reduction in noise transmission. Attachment means incorporated in the laminated construction affords convenient rivet attachment to the heddle frame slats and provides the additional result of accurate layer spacing in the lamination.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
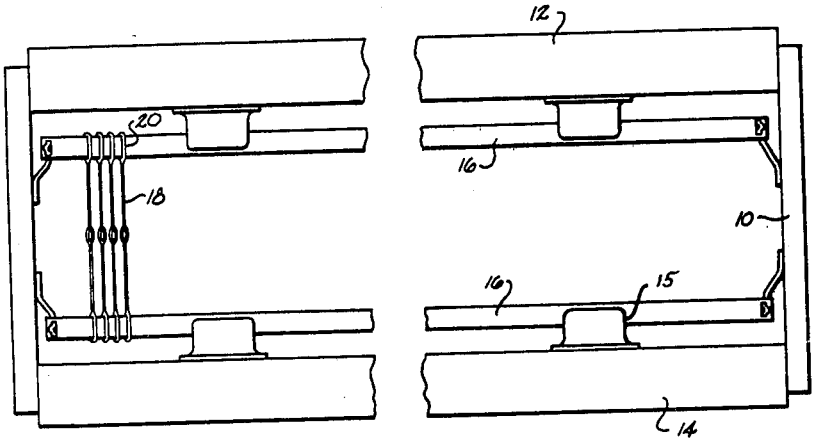
FIG. 1 is an elevation illustrating the front of a heddle frame for a loom incorporating heddle rods constructed according to the invention.
Figure 2:
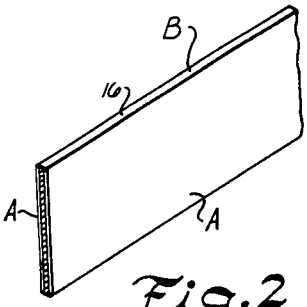
FIG. 2 is a perspective view illustrating a heddle rod constructed according to the invention.

The invention relates to a heddle frame 10 for a loom having top and bottom frame slats 12 and 14 having rod hooks 15 by which heddle rods, such as 16, are attached and carried by the slats. The heddle rods support heddles 18 in the frame 10 which heddles include end slots 20 receiving the heddle rod. In particular, the invention relates to the improvement wherein the heddle rod comprises a first elongated metal bar A and a second elongated metal bar A laterally spaced from the first bar being carried parallel to the first bar. A dissimilar metal and/or non-metallic intermediate layer B is interposed between the first and second bar. The first and second bars A and the intermediate layer B are secured together in a sandwiched configuration by suitable means. Means connecting the heddle rods to the frame slats are uniquely incorporated in each rod.

Referring now in more detail to the drawing, composite heddle rod 16 is disclosed as a sandwich construction including the two outer layers A and light-weight core layer B sandwiched therebetween. The layer A may be tempered carbon or stainless steel having a thickness of approximately 0.007 to 0.015 of an inch. The total thickness of the composite heddle rod is preferably between 0.065 and 0.075 inches. While layer B is preferably a suitable thermoplastic such as a hot melt adhesive, or a low temperature epoxy, a dissimilar, lightweight metal such as aluminum may also be advantageously utilized. The layers are secured together under pressure and heated to cause the plastic material to soften and adhere to outer layers A.

As a result of the sandwich construction and the thermoplastic layer in between the two metallic layers A, noise, normally inherent in operation of a loom upon which heddle frames are provided, is dampened considerably. It also provides a lighter weight heddle rod construction which may be moved more rapidly up and down during shedding. Center core B may also be a more rigid carbon or pultruded graphite composite such as graphite reinforcing fibers in a resin matrix. Normally, the top and bottom edges of the heddle rod strike the corresponding surfaces of the heddle eye where there is approximately one-eighth of an inch play at each end. An important advantage of the described construction is that the wear surfaces are shared by the metallic and non-metallic materials across the top and the bottom edges of the heddle rod. The transmission of noise and impact of the heddles and heddle rods throughout the entire heddle rod is effectively reduced by the sandwich construction.

The laminated structure is stronger than plating a metallic wear-resistant coating on a ceramic or fiber structure. The modulus of elasticity in the vertical direction is substantially greater than the plated or covered structures heretofore proposed. It is important that the rod be strong and stiff to properly support the heddles in the frame, yet deaden the transmission noise.

Metal bar A facing the frame permits use of connecting means in the form of stud 24 welded to the surface of the bar A. Alternately, a stud 26 may be utilized having a flange head 28 carried and bonded between the outer layers A. The free end of the stud may then be riveted in rod 15 by known techniques.

Figure 4:
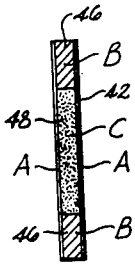
FIG. 4 is an end view of an alternate embodiment of a heddle rod constructed according to the present invention.
Figure 5:
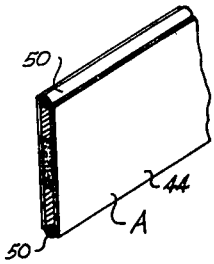
FIG. 5 is a perspective view of of an alternate embodiment of a heddle rod constructed according to the present invention.
Figure 5A:
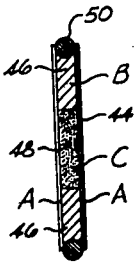
FIG. 5*a* is an end view of the heddle rod of FIG. 5.
Figure 6:
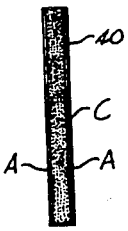
FIG. 6 is an end view of an alternate form of a heddle rod according to the invention.

In addition to utilizing the thermoplastic B, the inner layer may also be advantageously composed of material such as aluminum or a more rigid thermoplastic C such as nylon or the graphite pultrusion mentioned previously providing increased stiffness, as illustrated in heddle rod 40 of FIG. 6. In this case, a thin adhesive layer (not shown) would be employed bonding the nylon or graphite composite or dissimilar metals to the outer layers. Also, rigid and softer core materials may be combined to further decouple vibrations and thereby more effectively reduce noise such as in heddle rods 42 and 44. As best shown in FIGS. 4, 5, and 5*a*, rods 42 and 44 may include an inner core having spaced outer cores 46 and a more rigid central inner core 48, the outer cores sharing the impact and wear.

Figure 3:
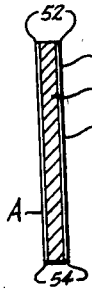
FIG. 3 is an end view of the heddle rod of FIG. 2.
Figure 3A:
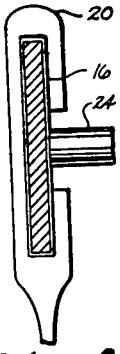
FIG. 3*a* is an end view of the heddle rod of FIG. 2 received in the rod slot of a heddle and provided with attachment means.
Figure 3B:
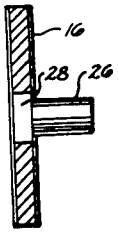
FIG. 3*b* is an end view illustrating an alternate construction and form of attachment means.

When the central core material B or C is compressible, it becomes an expedient to utilize an elongated rigid steel spacer, such as a small diameter rod 50, in order to provide that the bars A are correctly spaced and are parallel. Alternately, or in combination, the flange of rivet head 26 can also be used to accurately locate one outside bar from the other as best seen in FIG. 3*b*.

Thus, it can be seen that an advantageous construction for a heddle rod can be had according to the invention wherein the contact and wear surface between the heddle rod and heddle rod slot is shared by the metal and non-metal materials of different elasticity whereby both wear and noise are reduced while a construction having a high structural integrity and bending resistance is provided to withstand the rigors of operation. The side edges, upper 52 and lower 54, of metal bars A always provide most of the wear surface against the inside of the C-shaped slot of the heddle ends 20 while the inside core B shares some wear but most importantly provides reduction of noise transmission throughout the structure. A much more integritous structure is achieved as opposed to the platings, coverings, and inserts utilized heretofore. While a C-shaped slot is shown for purposes of illustration, it is to be understood that the invention applies to "O" and "J" shaped rod slots as well.

While a preferred embodiment of the invention has been described using specific terms, such description is for illustrative purposes only, and it is to be understood that changes and variations may be made without departing from the spirit or scope of the following claims.

What is claimed is:

1. In a heddle frame having top and bottom frame slats, heddle rods carried by said frame slats which support heddles having end slots carried on said heddle rods, the improvement wherein said heddle rods comprise:

a first elongated metal bar;

a second elongated metal bar laterally spaced from said first bar and being carried parallel to said first bar;

a non-metallic inner core interposed between said first and second bars;

means for securing said first and second metal plates and said intermediate non-metallic layer together in a sandwiched configuration; and means connecting said heddle rods to said frame slats.

2. The heddle rod of claim 1 wherein said heddle rod includes upper and lower wear surfaces including both metal and non-metal material sharing said wear, said metal wear surfaces provided by side edges of said outer metal bars impacting said heddle rod slot absorbing most of the wear.

3. The heddle rod as set forth in claim 1 wherein said connecting means includes longitudinally spaced studs each having one end welded to one of said metal bars of said rods and the other end adapted for attachment to a respective frame slat said metal bars being steel.

4. The heddle rod of claim 1 wherein said inner core includes a plastic adhesive.

5. The heddle rod of claim 4 wherein said inner core includes a non-metallic material being more rigid than said adhesive.

6. The heddle rod of claim 1 wherein said inner core includes spaced outer cores and a central inner core being of a more rigid material than said outer core material.

7. The heddle rod of claim 1 wherein said connecting means includes a stud having an enlarged flange head carried in said inner core intermediate said outer layers.

8. The heddle rod of claim 1 including elongated spacers extending longitudinally of said rod spacing said outer bars relative to one another.

* * * * *